United States Patent [19]

Lohrey et al.

[11] Patent Number: 4,556,822

[45] Date of Patent: Dec. 3, 1985

[54] MOUNTING STRUCTURE AND RELATED METHOD BOTH FOR A MULTI-FILAMENT INCANDESCENT LAMP

[75] Inventors: Edwin J. Lohrey, Euclid; Timothy C. Cho, Mayfield Hts., both of Ohio

[73] Assignee: General Electric Company, Schenectady, N.Y.

[21] Appl. No.: 607,838

[22] Filed: May 7, 1984

[51] Int. Cl.[4] ..... H01J 7/44

[52] U.S. Cl. ..... 315/67; 313/333; 313/344; 315/64

[58] Field of Search ..... 313/333, 344; 315/67, 315/64

[56] References Cited

U.S. PATENT DOCUMENTS

| | | | |
|---|---|---|---|
| 2,862,147 | 11/1958 | Conti | 315/65 |
| 3,131,986 | 5/1964 | Edwards | 339/146 |
| 3,504,218 | 3/1970 | Emidy | 313/344 |
| 4,400,646 | 8/1983 | Lohrey | 313/333 |

*Primary Examiner*—Harold Dixon

*Attorney, Agent, or Firm*—John P. McMahon; Philip L. Schlamp; Fred Jacob

[57] ABSTRACT

An improved mounting structure for a three-way incandescent lamp is disclosed. The improved mounting structure has a three-pillar stem in which the conductive leads rigidly dispose a minor and major filament within the three-way incandescent lamp. The improved mounting structure has a conductive support member in common with both the minor and the major filaments which achieves improved mounting stability of the minor and major filaments relative to prior three-way incandescent lamps. Also disclosed is a method for the improved mounting structure which simplifies the manufacturing process of the three-way incandescent lamp. Further disclosed in one embodiment is an improved mounting structure which achieves simultaneous burnout of minor and major filaments of the three-way incandescent lamp.

13 Claims, 13 Drawing Figures

MOUNTING STRUCTURE AND RELATED METHOD BOTH FOR A MULTI-FILAMENT INCANDESCENT LAMP

The present invention relates to incandescent lamps having multi-filaments. More particularly, the present invention relates to incandescent lamps having an improved structure for mounting of minor and major filaments and a method of forming the improved mounting structure.

Incandescent lamps having multi-filaments are well known and described as such in U.S. Pat. No. 3,131,986 of G. J. Edwards, issued May 5, 1964 and assigned to the same assignee as the present invention. U.S. Pat. No. 3,131,986 discloses a three-way incandescent lamp having a minor and a major filament and adapted for use in sockets having a switching arrangement for energizing the filaments individually, or both in multiple, so as to obtain three levels of desired illumination.

In such three-way incandescent lamps the minor and major filaments are rigidly disposed within the lamp bulb so as to withstand various shock and vibration forces without being damaged. The mounting for such minor and major filaments may comprise relatively complicated structures having sometimes as many as four support members with connections provided by means of welds.

An incandescent lamp having inleads with various bends for providing a rigid but simplified structure for mounting a single filament is disclosed in U.S. Pat. No. 4,400,646, issued Aug. 23, 1983, which is assigned to the same assignee as the present invention and further is herein incorporated by reference.

The filaments for both the single and three-way incandescent lamps are selected to have a desired and well-defined turns-per-inch (TPI) characteristic which in some cases results in a filament lacking in physical strength and in lamp performance as well. The mounting structure for the flimsy filament should take into account possible tangling problems of the filament itself, which, in turn, further complicates the mounting structure especially with regard to the minor filament of the three-way incandescent lamp. It is desired that a three-way incandescent lamp be provided with a structure having provisions to include mounting of flimsy filament while also providing such mounting with a relatively simplified structure.

The complexity of the mounting structure for the minor and major filament is of concern to the manufacturing process of the three-way incandescent lamp. It is desired that the mounting structure be improved in such a manner so as to simplify the manufacturing process of the three-way incandescent lamp.

Accordingly, it is the object of the present invention to provide an improved but simplified structure for mounting the minor and major filaments within a three-way incandescent lamp.

It is a further object of the present invention to provide a mounting structure which improves or simplifies the manufacturing process of the incandescent lamp having the major and minor filaments.

SUMMARY OF THE INVENTION

The present invention is directed to an improved structure and method for mounting the minor and major filaments of a three-way incandescent lamp.

The mounting structure comprises a three-pillar portion stem having inner and outer lead-in wires extending through each of the pillar portions. The inner lead-in wires each having a desired configuration with at least one reverse bend for providing stability for mounting the minor and major filaments. One of the inner lead-in wires having at least two hooked bends for respective clamp connections to one end of each of the minor and major filaments. The two other inner lead-in wires each having a hooked bend for a clamped connection to the other respective opposite end of the minor and major filaments. The material and the diameters of the outer lead-in wires are selected effective to predeterminedly establish individual or simultaneous termination of the operation of the minor and major filaments.

The features of this invention believed to be novel are set forth with particularity in the appended claims. The invention, itself, however, as regards to its structure, method and advantages thereof, may be more readily understood with reference to the following description taken in conjunction with the accompanying drawing.

DETAILED DESCRIPTION OF THE PREFERRED EMBODIMENTS

Figure 1:
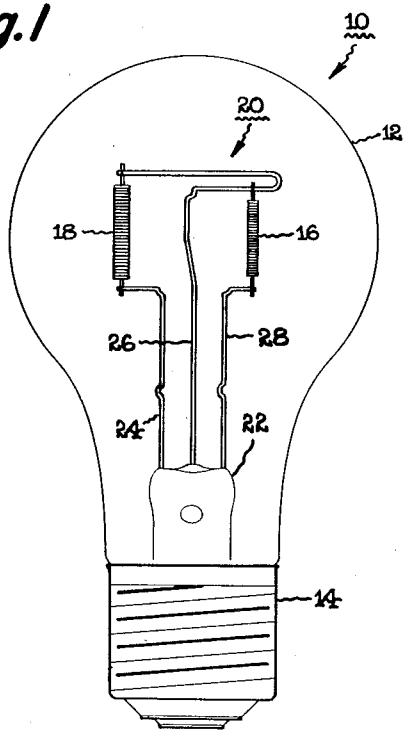
FIG. 1 illustrates one embodiment of the present invention showing a three-way incandescent lamp.

FIG. 1 illustrates a three-way incandescent lamp 10 in accordance with one embodiment of the present invention. The lamp 10 comprises light-transmissive outer envelope 12 which is sealed and attached to an electrically conductive screw-in base 14.

The lamp 10 further comprises a minor filament 16 and a major filament 18. The minor filament 16 may have a wattage rating in the range from about 15 to about 100, whereas, the major filament 18 may have a wattage rating in the range from about 70 to about 200. The minor filament 16 can be a coil-coiled type having a turns-per-inch (TPI) characteristic in the range from about 50 to about 100, whereas, the major filament 18 can also be a coil-coiled type having a TPI characteristic in the range from about 25 to about 100. The minor filament 16 and the major filament 18 are both spatially disposed and rigidly supported within the outer envelope 12 by an improved mounting structure 20 which is shown in detail in FIG. 2 as removed from lamp 10.

The mounting structure 20 has a stem 22 comprised of three-pillar shaped arrangement $\mathbf{22}_A$, $\mathbf{22}_B$, and $\mathbf{22}_C$ and a flare portion $\mathbf{22}_D$ all formed of glass or other electrically insulated material. The first $\mathbf{22}_A$, second $\mathbf{22}_B$ and third $\mathbf{22}_C$ pillar portions have respective first 24, second 26 and third 28 inner lead-in conductors or wires. The first $\mathbf{22}_A$, second $\mathbf{22}_B$, and third $\mathbf{22}_C$ pillar portions also have respective first 30, second 32 and third 34 outer lead-in conductors or wires connected to appropriate portions of the base 14.

The outer lead-in wires 30, 32 and 34 are selected to having particular characteristics determined by the desired modes A and B of the operation shown in Table 1 for three-way incandescent lamps 10.

TABLE 1

| Desired Modes of Operation of Lamp 10 | Typical Range of Diameter of Conductors in mm | | | Type of Wire of Conductors | | |
|---|---|---|---|---|---|---|
| | 30 | 32 | 34 | 30 | 32 | 34 |
| A | | | | | | |
| Individual Burnout of Minor and Major Filaments | 0.2 to 0.4 | 0.2 to 0.5 | 0.2 to 0.4 | Ni | Cu | Ni |
| B | | | | | | |
| Simultaneous Burnout of Minor and Major Filaments | 0.2 to 0.5 | 0.2 to 0.4 | 0.2 to 0.5 | Cu | Ni | Cu |

The desired mode A of operation for lamp 10 is achieved by selecting a fuse material, such as nickel (Ni), having the range of diameter shown in Table 1, for the material for outer lead-in wires 30 and 34 so that these wires 30 and 34 individually function as a fuse wire melting when the current flowing in either of the minor and major filaments, respectively, and passing through either of the wires 30 or 34 exceeds the current carrying capability of the individual wire 30 or 34. Similarly, the desired mode B of operation for lamp 10 is achieved by selecting a fuse material, such as nickel (Ni), having the diameter shown in Table 1, for the material for outer lead-in wire 32 so that the wire 32 functions as a fuse wire melting when the combined current flowing through the minor and major filaments and passing through the common wire 32 exceeds the current carrying capability of the wire 32.

The inner lead-in wires 24, 26, and 28 are cylindrical and have a diameter in the range shown in Table 2 which is dependent on the wattage of the minor and major filaments as also shown in Table 2.

TABLE 2

| Filaments of Lamp 10 | Approximate Range of Wattage of Filaments | Approximate Range of Diameter in mm of Inner Lead-in Wires | | |
|---|---|---|---|---|
| | | 24 | 26 | 28 |
| Minor | 15 to 100 | .25 to .36 | .36 to .56 | .25 to .36 |
| Major | 50 to 200 | .25 to .36 | .36 to .56 | .25 to .36 |

Figure 2:
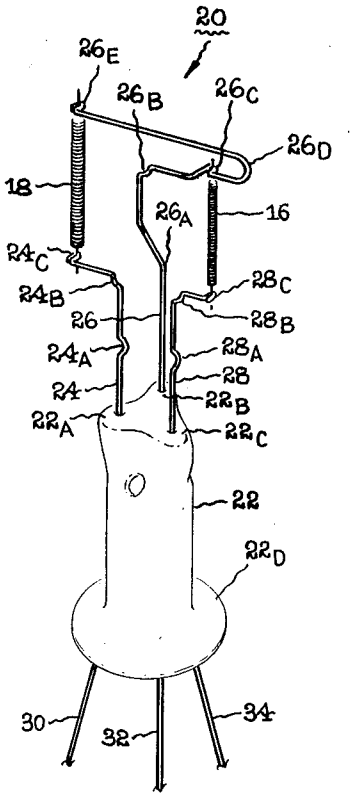
FIG. 2 shows an improved mounting structure in accordance with one embodiment of the present invention.

The inner lead-in wires 24, 26 and 28 are comprised of a plurality of various bends some of which are similar to the various bends disclosed in the hereinbefore incorporated by reference U.S. Pat. No. 4,400,646. For example, the central region of inner lead 24 has a reverse bend $24_B$ similar to the reverse bend 29 disclosed in U.S. Pat. No. 4,400,646 and to which reference may be made for further details. Similarly, the upper regions of inner lead-in wires 26 and 28 have a reverse bend $26_B$ and $28_B$, respectively, similar to the reverse bend 29 of U.S. Pat. No. 4,400,646. Still further, the central region of inner lead-in 26 has a slight bend $26_A$ similar to the slight bend 21 of U.S. Pat. No. 4,400,646. One of the outermost regions of inner lead-in wire 26 has a circular bend $26_D$ as shown in FIG. 2.

The inner lead-in wires 24, 26 and 28 each having at least one reverse bend, provide stability for the mounting of the minor 16 and major 18 filaments. The reverse bends of the inner lead-in wires 24, 26 and 28 confines the movement in a transverse manner even when the mounting structure 20 is arranged within the lamp 10 and the lamp 10 is subjected to normal usage typically experienced in a general lighting condition.

The inner lead-in wires 24, 26, and 28 respectively have hooked curved portions $24_C$, $26_C$ and $26_E$, and $28_C$ which provide for a hooked crimped connection of the minor 16 and major 18 filaments of the lamp 10. The minor filament 16 is rigidly disposed and electrically connected within lamp 10 by the crimped connections provided by $26_C$ and $28_C$. Similarly, the major filament 18 is rigidly disposed and electrically connected with lamp 10 by the crimped connections provided by $24_C$ and $26_E$.

The minor 16 and major 18 filaments are provided with a fixed orientation by the mounting structure 20 mainly comprised by the relatively few inner lead-in wires 24, 26 and 28 and such inner lead-in wires 24, 26 and 28 are rigidly affixed within the outer envelope 12 without the need of undesirable welds.

The mounting structure 20 in addition to the rigid orientation of the minor 16 and major 18 filaments provides the means for adapting or adjusting the turns-per-inch (TPI) of the minor 16 and major 18 filaments to the needs of the three-way incandescent lamp 10.

As discussed in the "Background" section hereinabove, the TPI needs to be a well-defined and maintained characteristic for each of the minor and major filaments. These filaments 16 and 18, particularly the minor filament 16 being of a relatively low wattage, may typically encounter sag or tangling problems in which the adjacent turns of the filaments may contact each other. It is of prime importance that adjacent turns of the filaments 16 and 18 be separated and such separation maintained during the operation of the lamp 10. The present invention primarily by means of punched curvatures $24_A$ and $28_A$ each having predeterminedly selected depths provide for an accurate and maintained TPI characteristics of filaments of the lamp 10.

The depth of each of the punched curvatures $24_A$ and $28_A$ is selected effective to provide sufficient tension in the filaments 16 and 18 effective to prevent the adjacent turns of these filaments 16 and 18 from touching both during the non-operative and operative conditions of the lamp 10. The curvatures $24_A$ and $28_A$ are provided in an axial manner into the inner lead-in conductors 24 and 28 after the filaments 16 and 18 are clamped between $28_C$ and $26_C$ and $24_C$ and $26_E$, respectively.

The axial manner in which the curvatures $24_A$ and $28_A$ are placed into inner leads 24 and 28, respectively, causes the filaments 18 and 16 to have a tension applied in an axial manner, which, in turn, allows the filaments 16 and 18 to each maintain the axial orientation within lamp 10. The process or method in which the curvatures $24_A$ and $28_A$ are applied, along with the overall formation of the mounting structure 20, may be described with reference to FIGS. 3(*a*)–3(*j*).

The practice of the present invention provides a method shown in FIGS. 3(*a*)–3 (*j*) which substantially eliminates the complications typically experienced in the manufacturing process of a three-way incandescent lamp.

FIGS. 3(*a*), 3(*b*), 3(*c*), 3(*d*), 3(*e*), 3(*f*), 3(*g*), 3(*h*), and 3(*i*) and 3(*j*) correspond to steps a, b, c, d, e, f, g, h, i, and j, respectively, of one of the preferred methods of the present invention. As previously mentioned, the inner lead-in wires of the present invention have reverse bends, such as $24_B$ of inner lead-in wire 24, and slight bends, such as $26_A$, similar to those of 29 and 21, respectively, of U.S. Pat. No. 4,400,646. The following description of steps b, c, and d makes reference to U.S. Pat. No. 4,400,646 which may be referred to for a more detailed description for forming the reverse bends and slight bends of the present invention.

FIG. 3(*a*) shows step (a) in which the mounting structure 20 to be fabricated is placed in its initial oriented position for processing. The outer lead-in wire 26 has a length of about twice that of either lead-in wires 24 and 28.

FIG. 3(*b*) shows the step (b) in which the inner lead-in wires 24 and 28 are provided with reverse bends $24_B$ and $28_B$, respectively, in their central regions in a similar manner as described with regard to FIGS. 2 and 3 of U.S. Pat. No. 4,400,646.

FIG. 3(*c*) shows step (c) in which the inner lead-in wire 26 is provided with a slight bend $26_A$, in its central region in a manner as described in U.S. Pat. No. 4,400,646.

FIG. 3(*d*) shows step (d) in which the inner lead-in wire 26 is provided with a reverse bend $26_B$ at a location along the conductor 26 so as to provide a sufficient distance between conductors 26 and 28 for later connection of the minor filament 16. The reverse bend $26_B$ is provided in a manner similar to that described in U.S. Pat. No. 4,400,646.

FIG. 3(*e*) shows the step (e) in which hooked-like curvatures $26_C$ and $28_C$ are placed into the inner lead-in wires 26 and 28 respectively. To accomplish such hooked curvatures the inner lead-in wires 26 and 28 are arranged against a punch and die having an opening and a force is simultaneously applied by means of the punch against both the inner leads 26 and 28 at the opening of the die so that the inner lead-in wires 26 and 28 each take the shape of the inner surfaces of the die to form the hooked curvatures $26_C$ and $28_C$.

FIG. 3(*f*) shows step (f) in which the minor filament 16 is positioned between hooked curvatures 26(C) and 28(C) and then a force is applied to each curvature $26_C$ and $28_C$ to cause the filament 16 to be crimped in place.

FIG. 3(*g*) shows step (g) wherein the inner lead-in wire 26 is gripped by an appropriate device and is then wrapped around a die to cause the inner lead-in wire 26 to be rotated by a bend $26_D$ which reverses the direction of the inner lead-in wire 26.

FIG. 3(*h*) shows step (h) similar to step (e) in which the hooked curvatures $24_C$ and $26_E$ are placed in their respective inner lead-in wires 24 and 26.

FIG. 3(*i*) shows the step (i) in which the major filament 18 is mounted between hooked arrangements $24_C$ and $26_E$ and provided with a crimping action so as to crimp the major filament 18 therebetween.

The final step (j) of the preferred embodiment is shown in FIG. 3(*j*). FIG. 3(*j*) shows the punched curved portions $24_A$ and $28_A$ previously discussed as related to the TPI of minor and major filaments 16 and 18, respectively. The depth of punched portions is predeterminedly selected to correspond to the desired TPI of the minor and major filaments and representative values of all are given in Table 3.

TABLE 3

| Depth of Indentation | Approximate Range of TPI of Minor Filament | Approximate Range of TPI of Major Filament |
|---|---|---|
| $28_A$ - 1 mm | 50 to 150 | |
| $24_A$ - 1 mm | | 25 to 100 |

The portions $24_A$ and $28_A$ are simultaneously placed into inner leads 24 and 28, respectively, by placing the inner lead-in wires 24 and 28 against a die having an opening and curved inner surfaces and then applying a force by a device in a rapid and quick manner. After the rapid force is applied the formation of the mounting structure 20 is accomplished.

Upon completion of the final step (j) the improved mounting stem structure 20 is positioned and located within the incandescent lamp and provided with appropriate connections of its outer lead-in wires 30, 32 and 34 to the electrically conductive base 14 in a manner well-known in the art.

It should now be appreciated that the practice of the present invention provides for an improved three-pillar mounting stem structure which, in addition to providing for ease of fabrication, also provides for easily adapting the well-defined TPI characteristic to the needs of various three-way incandescent lamps 10.

Figure 4:
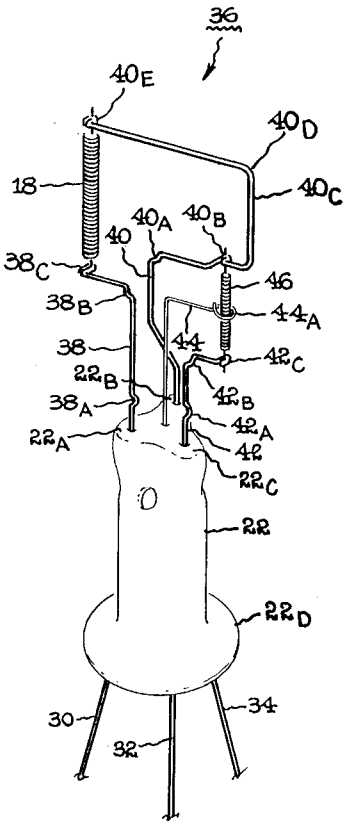
FIG. 4 shows another embodiment of an improved mounting structure of the present invention.
Figures 3A, 3B, 3C, 3D, 3E:
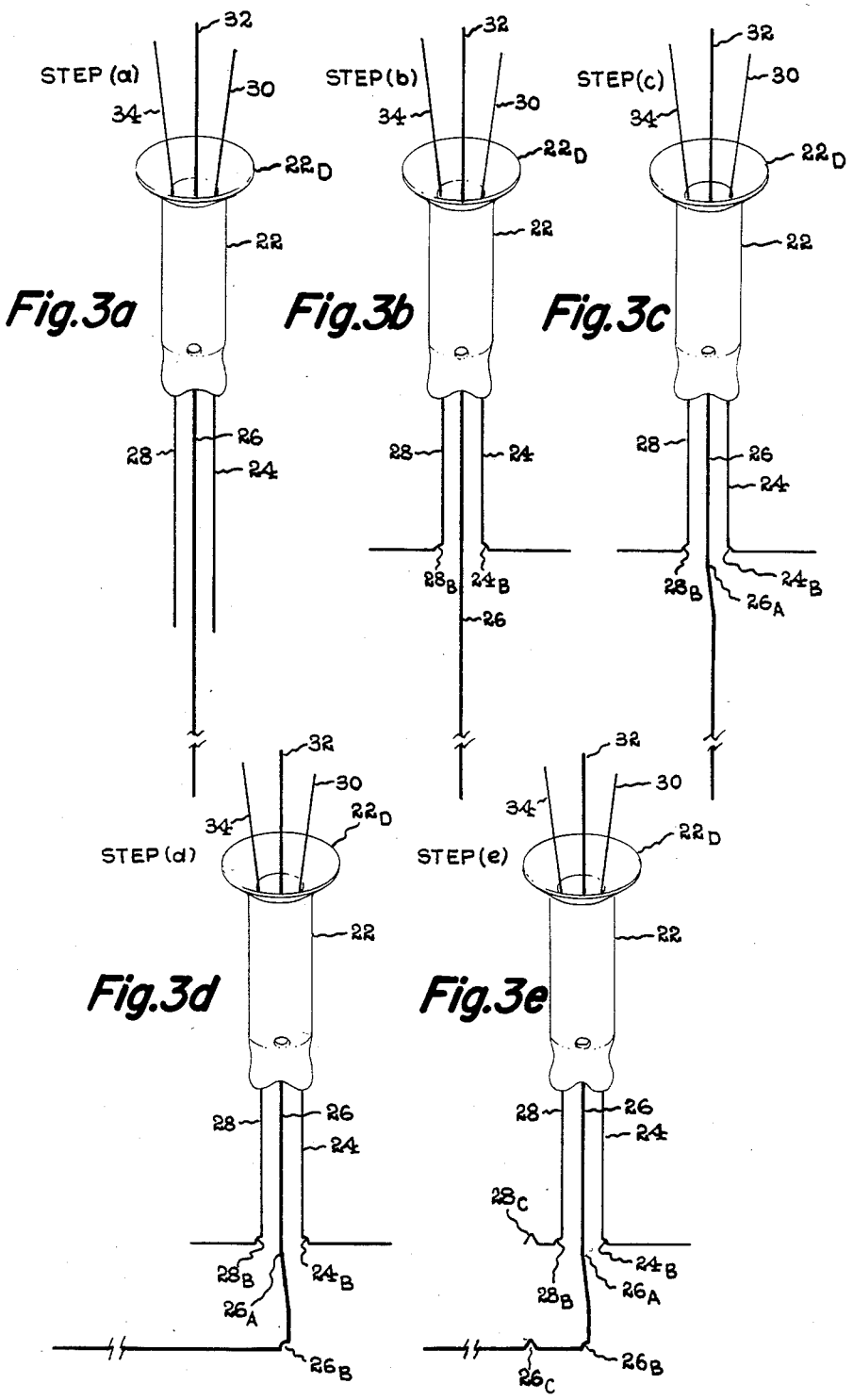
FIGS. 3(*a*)–3(*j*) illustrate a method for accomplishing the formation of the mounting structure of the lamp of FIG. 1.
Figure 3F:
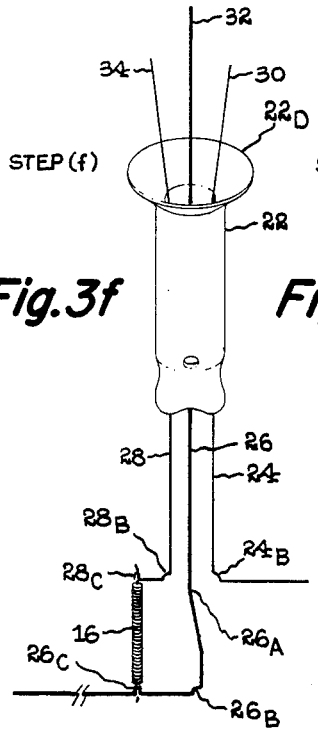
Figure 3G:
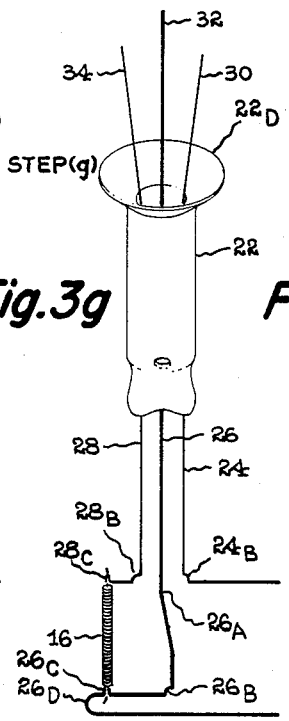
Figure 3H:
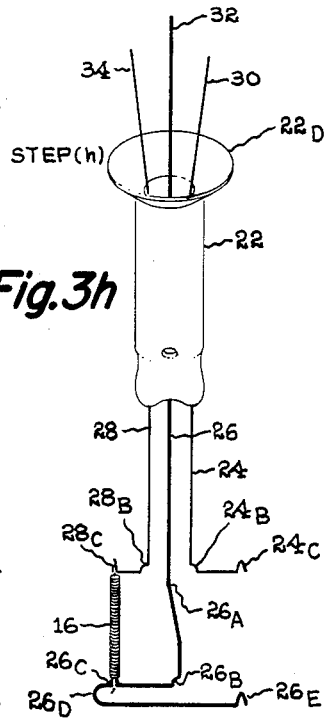
Figure 3I:
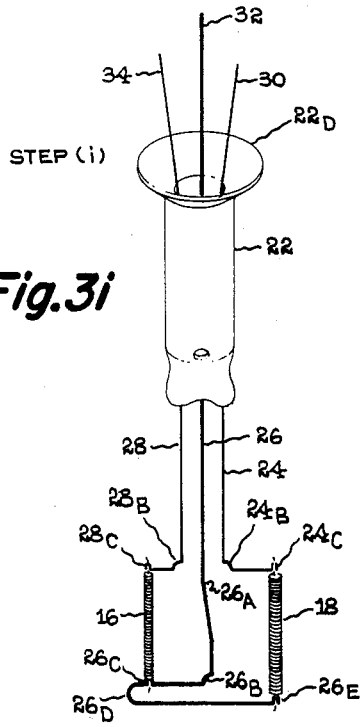
Figure 3J:
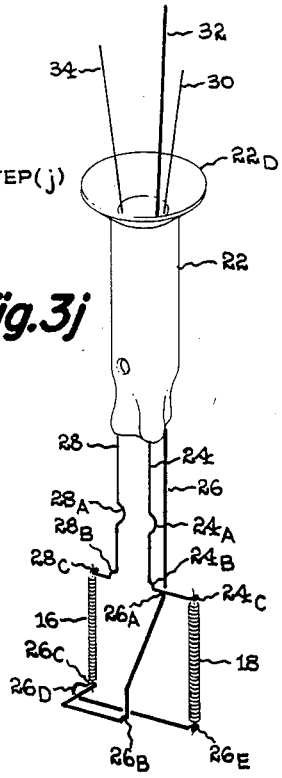

A second embodiment of the present invention is shown in FIG. 4 for an improved mountinq stem 36. The mounting structure 36 is similar to the mounting structure 20 and comprises the three-pillar stem 22 along with the outer lead-in wires 30, 32 and 34 previously described with regard to FIG. 2 and Table 1, respectively. Further, the mounting structure 36 comprises inner lead-in wires 38 and 42 similar to inner lead-in wires 24 and 28 of FIG. 2. The inner lead-in wire 38 has the pinched portions $38_A$, the reverse bend $38_B$ and the hooked crimped connection $38_C$, respectively, similar to $24_A$, $24_B$ and $24_C$ described for inner lead-in wire 24, whereas, the inner lead-in wire 42 has the punched portion $42_A$, reverse bend $42_B$ and hooked crimped connection $42_C$, respectively, similar to $28_A$, $28_B$ and $28_C$ for inner lead-in wire 28.

The mounting structure 36 differs from mounting structure 20 in (1) the arrangement of its inner lead-in wire 40 common to the minor and major filament, and (2) the addition of a support member 44 for a minor filament 46 having a relatively low wattage rating compared to the minor filament 16 associated with the mounting structure 20.

The common inner lead-in wire 40 of FIG. 4 has a reverse bend $40_A$, a hooked clamped connection $40_B$ and a hooked clamped connection $40_E$, respectively, similar to $26_B$, $26_C$ and $26_E$ of inner lead-in wire 26. Unlike inner lead-in wire 26, the inner lead-in wire 40 has a section $40_C$ providing a smaller separation between $40_B$ and $42_C$ so as to accommodate the smaller minor filament 46 relative to the minor filament 16 of FIG. 2.

The inner lead-in wires 38, 40 and 42 each having at least one reverse bend provide stability for mounting the minor 46 and major 18 filament in a manner similar to that described for inner lead-in wires 24, 26 and 28.

The minor filament 46 has a typical wattage rating in the range from about 5 to about 15, and a typical turns-per-inch in the range of about 100 to about 250. For such a minor filament 46, in addition to the stability provided by inner leads 38, 40 and 42, it is desired that support member 44 be sealed within the stem 22 and have a loop portion $44_A$ to further confine the horizontal movement of the minor filament 46.

The mounting structure 36 is formed in a manner similar to that described with regard to FIGS. 3(*a*)–3(*j*) with the exception that the initial step, similar to step (a), provides an initial mounting structure additionally having the support member 44 and further that the placement of the minor filament 46, similar to step (i), includes locating and affixing the loop $44_A$ around the minor filament after the minor filament 46 is crimped in place.

It should now be appreciated that the present invention provides various embodiments along with the various methods all for improved but simplified structures for mounting the minor and major filaments within a three-way incandescent lamp.

What we claim as new and desire to secure by Letters Patent of the United States is:

1. In a multi-filament incandescent lamp adapted to operate at different levels of illumination comprising an outer envelope sealed and connected to an electrically conductive screw-in base, said lamp further comprising a minor and a major both spatially disposed and supported within said outer envelope by an improved mounting stem structure comprising:

a three-pillar portion stem having inner and outer lead-in wires extending through each of the three pillar portions with one end of each of said outer lead-in wires appropriately connected to said electrically-conductive screw-in base, said inner lead-in wires each having a desired configuration with at least one reverse bend for providing stability for mounting said minor and major filaments, one of said inner lead-in wires having at least two hooked bends for respective clamp connections to one end of each of said minor and major filaments, the other two inner lead-in wires each having a hooked bend for a clamped connection to the other respective opposite ends of said minor and major filaments.

2. A multi-filament incandescent lamp according to claim 1 wherein the material and the diameters of the outer lead-in wires are selected effective to predeterminedly establish individual termination of the operation of the minor and major filaments.

3. A multi-filament incandescent lamp according to claim 2 wherein two of said outer lead-in wires respectively connected to said minor and major filaments are of a nickel material and each have a diameter of about 0.2 mm to about 0.4 mm, said other outer lead-in wire which is common to both of said minor and major filaments is of a copper material having a diameter of about 0.2 mm to about 0.5 mm.

4. A multi-filament incandescent lamp according to claim 1 wherein the material and the diameters of the outer lead-in wires are selected effective to predeterminedly establish simultaneous termination of the operation of the minor and major filaments.

5. A multi-filament incandescent lamp according to claim 4 wherein two of said outer lead-in wires respectively connected to said minor and major filaments are of a copper material and each have a diameter of about 0.2 mm to about 0.5 mm, said other outer lead-in wire which is common to both of said minor and major filaments is of a nickel material having a diameter of about 0.2 mm to about 0.4 mm.

6. A multi-filament incandescent lamp according to claim 1 wherein said minor filament has a wattage rating in the range of about 15 to about 100 and said major filament has a wattage rating in the range of about 50 to about 200.

7. A multi-filament incandescent lamp according to claim 6 wherein said inner lead-in connected to both of said minor and major filament has a diameter in the range of about 0.36 mm to about 0.56 mm, and said other two inner lead-in wires each have a diameter in the range of about 0.25 mm to about 0.36 mm.

8. A multi-filament incandescent lamp according to claim 6 wherein said minor filament is of a coil-coiled type having a turns-per-inch characteristic in the range from about 50 to about 100, and said major filament is of a coil-coiled type having a turns-per-inch characteristic in the range from about 25 to about 100.

9. A multi-filament incandescent lamp according to claim 1 further comprising a support member sealed in said three-pillar portion stem and having a loop portion positioned around the central region of said minor filament effective to confine the horizontal movement of said minor filament.

10. A multi-filament incandescent lamp according to claim 9 wherein said minor filament has a wattage rating in the range of about 5 to 15 and a turns-per-inch characteristic in the range of about 100 to about 200.

11. A multi-filament incandescent lamp according to claim 10 wherein the material and the diameters of the outer lead-in wires are selected effective to predeterminedly establish individual termination of the operation of the minor and major filaments.

12. A multi-filament incandescent lamp according to claim 10 wherein the material and the diameters of the outer lead-in wires are selected effective to predeterminedly establish simultaneous termination of the operation of the minor and major filaments.

13. A method of forming an improved mounting stem structure for a multi-filament incandescent lamp comprising the steps of:

(a) providing a three-pillar portion stem having inner and outer lead-in wires extending through each of the three pillar portions with one of said outer lead-in wire having a length greater than the other two;

(b) placing a reverse bend in the central region of each of the shorter inner lead-in wires to be respectively connected to the minor and major filaments;

(c) placing a slight bend in the central region of the longer inner lead-in wire to be connected to both the minor and the major filaments;

(d) placing a reverse bend in the inner lead-in wire of step 13(c) at a location along the conductor so as to provide a sufficient distance between one of the inner lead-in wires of step 13(b) and said inner lead-in wire of step 13(c) for latter connection of a minor filament;

(e) placing hooked-like curvatures into the inner lead-in wires of step 13(d) by positioning said inner lead-in wires against a die having an inner surface with a hooked-like shape and apply a force so that said inner lead-in wires take the shape of said inner surface;

(f) placing the minor filament between the hooked-like curvatures of the inner lead-in wires of step 13(e) and applying a force to crimp said minor filament in place;

(g) gripping the inner lead-in wire of step 13(d) and then wrapping the inner lead-in wire around a die to cause the inner lead-in wire to be rotated by bend which reverses the direction of the inner lead-in wire;

(h) placing hooked-like curvature in the inner lead-in wire of step 13(g) and the other inner lead-in wire of a major filament in a manner given in step 13(e);

(i) placing and crimping in place the major filament between said hooked-like curvatures of step 13(h) in a manner given in step 13(f); and (j) applying a rapid and quick force onto the inner lead-in wires respectively connected to the minor and major filament so that each of the inner lead-in wires has a punched curved surface with a depth selected to establish and maintain a preselected turns-per-inch characteristic for each of said minor and major filaments.

* * * * *